United States Patent [19]

Ito et al.

[11] Patent Number: 4,542,585

[45] Date of Patent: Sep. 24, 1985

[54] HAIR CLIPPER

[75] Inventors: Kenzo Ito; Shiro Mizobata, both of Hikone, Japan

[73] Assignee: Matsushita Electric Works, Ltd., Osaka, Japan

[21] Appl. No.: 527,433

[22] Filed: Aug. 29, 1983

[30] Foreign Application Priority Data

Sep. 20, 1982 [JP] Japan ..... 57-163555

[51] Int. Cl.[4] ..... B26B 19/02

[52] U.S. Cl. ..... 30/210; 16/110 R; 16/DIG. 12; 16/DIG. 19; 30/248

[58] Field of Search ..... 30/45, 85, 90, 196, 30/197, 196.5, 203, 208, 210, 216, 298; 16/110 R, 111 R, DIG. 12, DIG. 18–DIG. 19, 114 R, DIG. 24, DIG. 39, 126, 127; 294/33

[56] References Cited

U.S. PATENT DOCUMENTS

| | | | |
|---|---|---|---|
| 1,987,444 | 1/1935 | Jeppsson | 30/216 |
| 3,372,481 | 3/1968 | Skinner | 30/210 |
| 4,083,102 | 4/1979 | Harshberger | 30/45 |
| 4,120,073 | 10/1978 | Studebaker | 294/33 X |
| 4,157,763 | 6/1979 | Betlejewski et al. | 16/126 |
| 4,266,341 | 5/1981 | Claassens | 30/210 X |

FOREIGN PATENT DOCUMENTS

| | | | |
|---|---|---|---|
| 520839 | 7/1953 | Belgium | 16/114 R |
| 11023 | of 1898 | United Kingdom | 30/298 |

*Primary Examiner*—Douglas D. Watts

*Attorney, Agent, or Firm*—Stevens, Davis, Miller & Mosher

[57] ABSTRACT

A powered hair clipper for use in cutting human hair is disclosed. The clipper comprises a tubular housing defining a handle to be grasped by a skillful hand of an operator and having a power driven cutter assembly at its forward end. The housing is provided with finger hooking means projecting outwardly and radially from the rear portion thereof so as to receive therein at least one of the middle, ring, and little fingers of the same hand grasping the clipper. With the help of the finger hooking means, the operator can carry the clipper by one or more fingers of his skillful hand such that the operator has no necessity of turning aside the clipper at each time when the same skillful hand takes over the handle a comb for arranging straggled or disordered hair strands prior to the trimming operation of advancing the clipper. Thus, the operation of arranging the hair strands can be immediately followed by the trimming operation with the clipper held in the same hand, enabling the operator to complete hair trimming in a shorter time and in a comfortable manner.

6 Claims, 20 Drawing Figures

HAIR CLIPPER

BACKGROUND OF THE DISCLOSURE

1. Fields of the Invention

This invention is directed generally to a power driven hair clipper, more particularly to a power driven clipper for home or professional use in cutting human hair.

2. Description of the Prior Art

In the general operation of trimming human hairs using a hair clipper, it is highly desirable to hold the hair to be cut between the fingers of an operator after arranging straggling or disordered strands of hair by the use of a comb rather than to hold the same between the teeth of the comb, since the hair strands held between the teeth of the comb will easily slip away through the teeth thereof such that the clipper fails to follow a correct or desired cutting line through hair styling. The human fingers will exhibit flexibility against the strands of hair held therebetween so that the strands once held are brought into more tightly frictional engagement with the fingers and are kept in position to be ready for cutting operation. Accordingly, more accurate cutting along a desired line can be achieved by holding the hair strands between the fingers of one hand while advancing the clipper grasped by the other hand of the operator, such cutting operation requiring the operator to manipulate both the clipper and the comb in one hand, practically in the skillful hand of the two for achieving easy and effective trimming along a desired line. That is, the skillful hand firstly takes the role of handling the comb to arrange therewith the straggling or disordered strands of hair, which is then held between the fingers of the opposite hand, thereafter the skillful hand takes over to advance the clipper through the strands of hair kept in position by the opposite hand. However, the operator may have certain troubles in performing the above cutting operation with prior hair clippers powered by electricity or air pressure, for example, the clipper may sometimes fall out of the hand of the operator or the clipper may cut the hair excessively during the operation of arranging the hair with the comb held together with the clipper in one's skillful hand. To prevent these troubles, it has been a common practice to put the clipper on a neighboring table each time of handling the comb, which renders the cutting or trimming operation a complicated and time-consuming one and as well fatigues the operator who is required to turn aside so many times from the subject hair for putting the clipper on the table therearound during the cutting operation.

SUMMARY OF THE INVENTION

In accordance with the present invention, the foregoing disadvantages as seen in the conventional trimming operation with a powered clipper and a comb in one hand are overcome by the provision of finger hooking means projecting on a hair clipper having a cutting assembly at its forward end. The finger hooking means projects outwardly and radially from the rear portion of the housing defining the handle of the hair clipper and is designed to have at least one eye for receiving therein any one of the middle, ring, and little fingers of the hand of an operator grasping the housing. With the help of the finger hooking means, an operator holding both the clipper and the comb in his skillful hand can suspend the clipper by one or more fingers of the same hand at each time that the comb takes over for arranging the hair strands such as to release without dropping the clipper the remaining fingers and the thumb, which are cooperative to hold therebetween the comb for facilitating the arrangement of hair strands by the same skillful hand. Immediately after the hair strands being ordered by the comb, the opposite hand will participate to hold the ordered hair strands between the index and middle fingers thereof at the same time accepting the comb from the skillful hand between the thumb and the adjacent side of the palm to be ready for advancing the clipper grasped within the palm of the skillful hand through the hair strands thus held. In this way, the operator utilizes his skillful hand to a maximum so as to manipulate easily the comb and the clipper as holding the hair strands by the opposite hand even without releasing the clipper and the comb during hair trimming operation. This allows the operator to advance the clipper skillfully and correctly along a desired line of cutting through hair strands so as to provide a neatly finished hair style and still prevents the dropping of the clipper from the hand of operator when the comb is handled by the same hand holding the clipper, rendering the operator free from the annoying operation of putting the clipper down on a table or the like at each time of handling the comb and causing no fatigue in his trimming operation.

Accordingly, it is a primary object of the present invention to provide a hair clipper which can be kept suspended by the skillful hand of the operator during the arranging operation of straggled or disordered hair strands with a comb in the same skillful hand so as to achieve efficient and rapid trimming operation without resorting to putting down the clipper on a neighboring table or the like.

In the preferred embodiments, a switch handle for turning on and off the reciprocal motion of the cutter assembly is mounted on the housing of the clipper at the location easily accessible by the thumb of the hand holding the clipper with the fingers extending in said finger hooking means, assuring easy switch handling operation. The cutter assembly mounted on the forward end of the housing includes a movable cutter driven to reciprocate in sliding relationship with respect to a fixed cutter and to define a cutting plane between these cutters. Also in the preferred embodiments of the present invention, said finger hooking means is designed to project outwardly from the rear portion of the housing in a plane parallel to the above cutting plane such that the finger hooking means will not constitute a hindrance to the trimming operation of the hair at the back of the head, particularly at the lower part thereof, assuring the operator the ability to advance the clipper in a comfort and relaxed manner with the cutting plane being substantially in parallel with the contour of the back of head.

Therefore, it is another object of the present invention to provide a hair clipper which can be easily handled for trimming the hair at the back of the head while retaining the advantages from the provision of the finger hooking means.

Further included in the present invention is an embodiment wherein said finger hooking means is so mounted on the housing to be slidable in the direction of approaching the cutter assembly at the forward end and an embodiment wherein said finger hooking means is arranged to selectively assume different angular positions about the longitudinal axis of the housing. In consequence of these features, the clipper can meet varying palm sizes of the different persons holding the clipper and can be adapted to be handled both by right-handed and left-handed persons simply by changing the angular position of the finger hooking means between two diametrically opposed positions.

The present invention discloses still further characteristic constructions designed to be convenient for storing the clipper in a relatively small space when out of use and as well convenience in replacing a battery employed to drive the cutter assembly.

These and other objects and advantages of the present invention will become more apparent from the detailed description thereon taken with the accompanying drawings.

DETAILED DESCRIPTION OF THE PREFERRED EMBODIMENT

Figure 1:
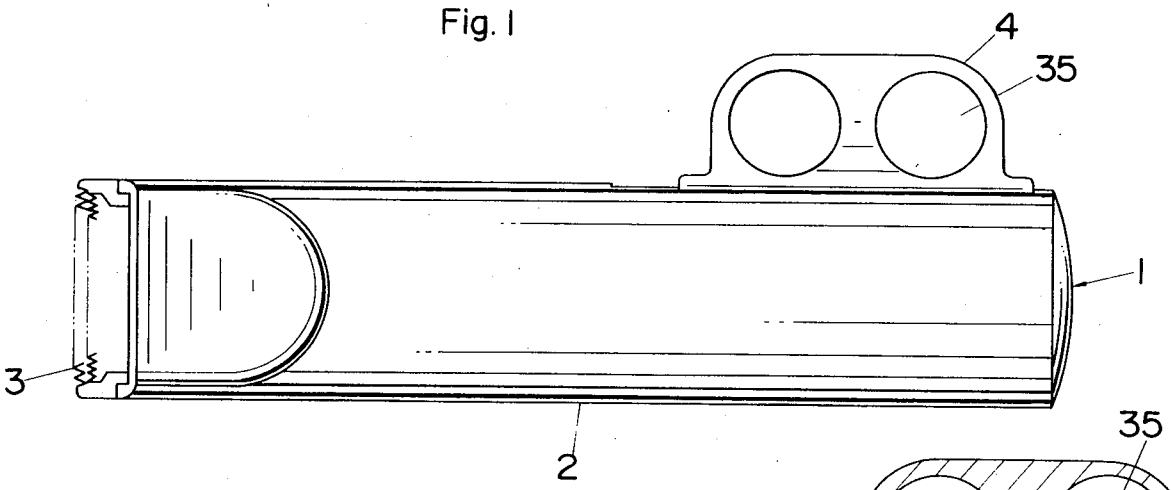
FIG. 1 is a front elevation of a hair clipper in accordance with one preferred embodiment of the present invention.
Figure 2:
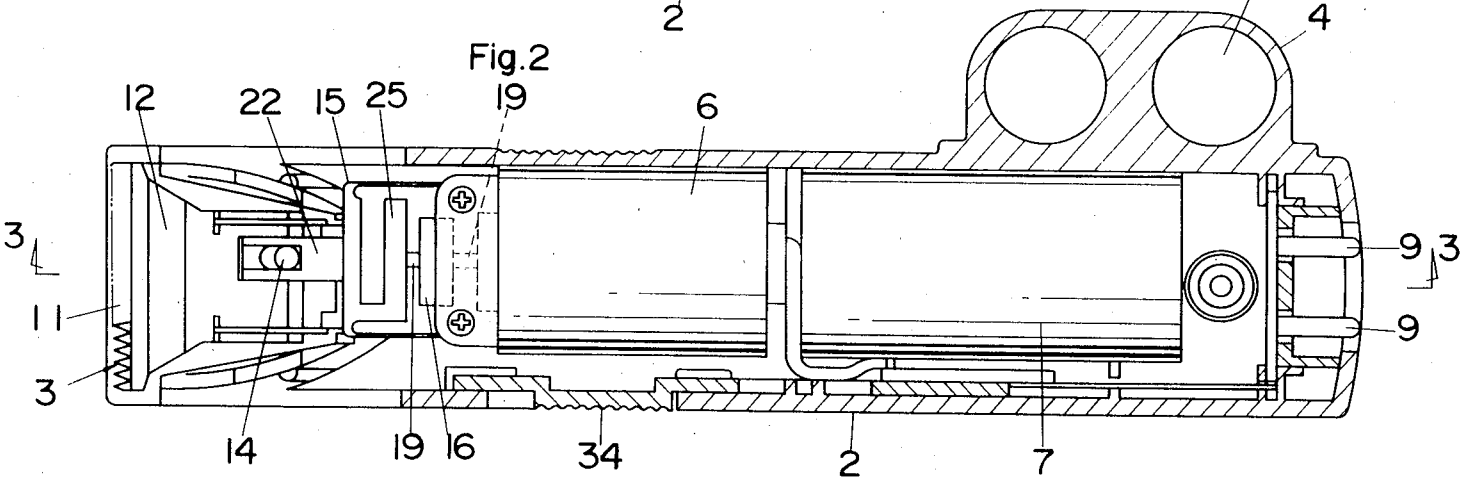
FIG. 2 is a longitudinal section of the above hair clipper.
Figure 3:
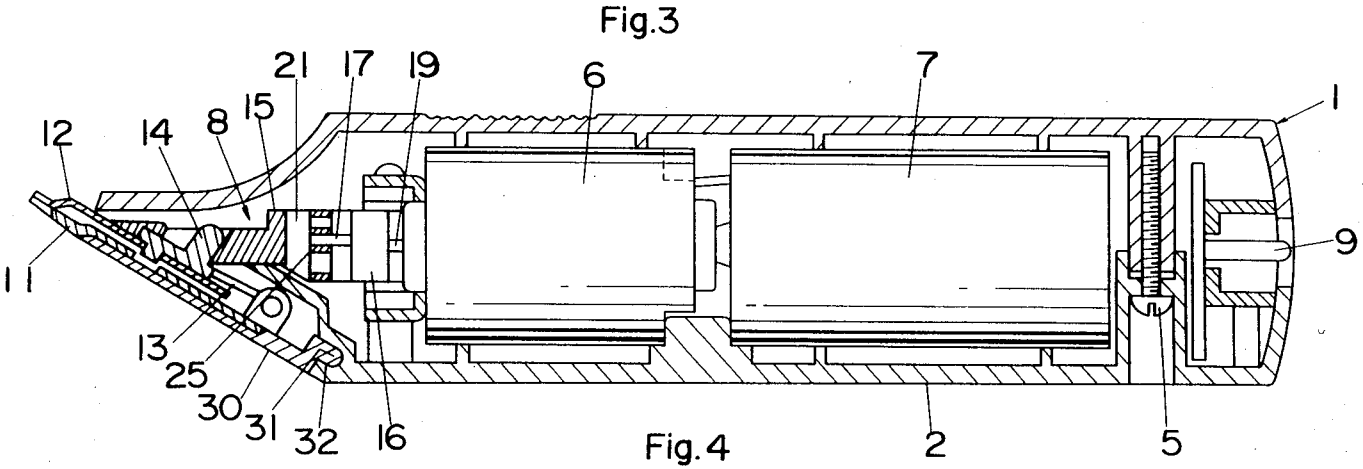
FIG. 3 is a cross section taken along the line 3—3 of FIG. 2.
Figure 4:
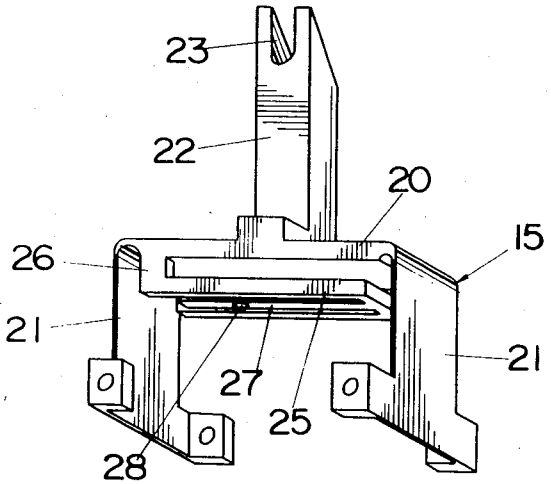
FIG. 4 is a perspective view of an output member employed in the above embodiment.

Referring now to the drawings and particularly to FIGS. 1 through 4, there is illustrated one preferred embodiment of a hair clipper 1 which comprises a housing 2 having at its forward end a cutter assembly 3 and finger hooking means 4 at its rear portion. The housing 2 is formed of two halves made of synthetic resin which are coupled together by a screw 5 to define a hollow structure for receiving therein an electric motor 6, a rechargeable battery 7, and a drive mechanism 8. The rechargeable battery 7 is connected to a pair of male terminals 9 disposed in the rear end of the the housing 1, the terminals 9 being connected to a battery recharging unit of conventional construction which is connected to a domestic ac power outlet to provide power to the rechargeable battery 7. The motor 6 receiving power from the battery 7 moves the drive mechanism 8 to operate the cutter assembly 3. The cutter assembly 3 comprises a toothed stationary cutter 11 and a toothed movable cutter 12 in juxtaposed relationship and defining therebetween a cutting plane which extends transversely of the longitudinal axis of the housing 2 and is inclined with respect to a plane normal to that axis. The movable cutter 12 is biased against the stationary cutter 11 by a spring 13 and carries a projection 14 which engages with said drive mechanism to establish driving connection between the cutter assembly 3 and the motor 6. Said drive mechanism 8 includes an output member 15 and a cam 16 with an eccentric pin 17. As best illustrated in FIG. 4, the output member 15 is formed on a synthetic resin to constitute an integral configuration which comprises a rigid base 20, a pair of opposite resilient legs 21 extending toward the motor 6 from the opposite lateral ends of the base 20, a post 22 extending forwardly of the base 20 and having at its top portion a concave portion 23 receiving said projection 14 on the movable cutter 12, a coupling element 25 extending in the opposite direction of said post 22 via rigid stems 26 from the base 20 and being shaped to have a generally E-shaped configuration including a resilient tongue 27 with a hole 28 for receiving the eccentric pin 17 extending from the cam 16 through which an output shaft 19 of the motor 6 extends coaxially. The output member 15 thus constructed is disposed between the motor 6 and the cutter assembly 3 with its resilient legs 21 secured at respective rear ends to the motor 6 and operates to convert the rotational motion of the motor 6 into reciprocatory motion of the movable cutter 12 as the resilient legs 21 swing to reciproctate the base 20 in lateral direction thereof and at the same time the tongue 27 of the coupling element 25 swings independently of the base 20 to prevent the reciprocatory motion in the direction perpendicular to the above direction from being transmitted to the base 20. Said cutter assembly 3 further include a supporting plate 30 on which the stationary cutter 11 is fixedly mounted such that the cutter assembly 3 is fashioned in the form of a single block construction, which is fitted readily to the housing 2 by inserting respective protrusions 31 (only one of which is shown) at opposite end portions of the supporting plate 30 within corresponding recesses, one recess 32 formed integrally in the housing 2 and the other (not shown) formed in a clamp spring fixed on the housing 2. A slide switch 34 by the operation of which the motor 6 is energized to reciprocate the movable cutter 12 is mounted on the outer periphery of the housing 2 at the location near the cutter assembly 3 so as to be easily accessible by the thumb of an operator holding the hair clipper 1.

Said finger hooking means 4 projects outwardly and radially from the rear portion of the housing 2 in a plane parallel to said cutting plane of the cutter assembly 3. In the present embodiment illustrated in FIGS. 1 through 4 the finger hooking means 4 is formed integrally with the housing 2 and is designed to have a pair of eyes 35 for receiving therein two adjacent ones of the middle, ring, and little fingers of the hand holding the hair clipper 1, as in the manner shown in FIG. 5. In this connection, said slide switch 34 is disposed at a location diametrically opposite to the finger hooking means 4.

Figure 5:
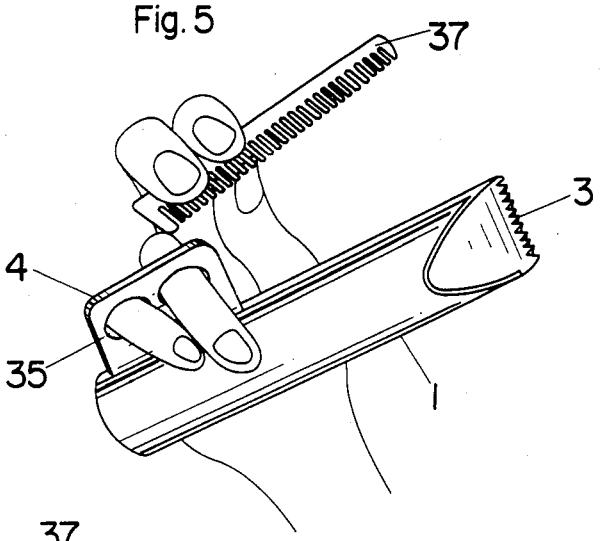
FIGS. 5 through 7 are explanatory views respectively illustrating the manner how the hair clipper of the present invention is manipulated.
Figure 6:
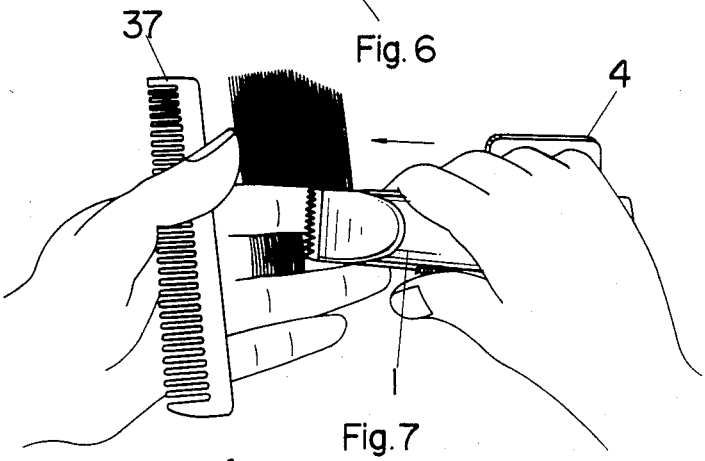
Figure 7:
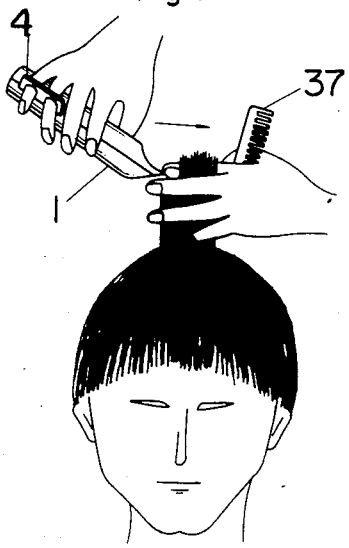
Figure 8:
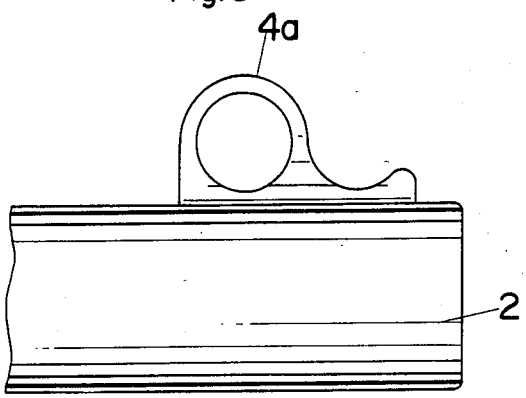
FIGS. 8 and 9 are partial views respectively illustrating modified configurations of finger hooking means which may be introduced in the hair clipper of the above embodiment.
Figure 9:
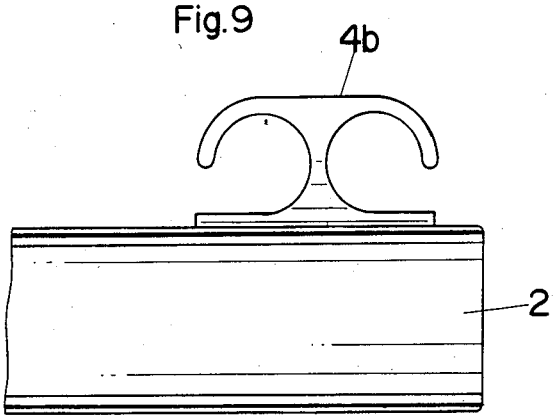

Operation of the above hair clipper 1 is now discussed with reference to FIGS. 5 through 7. Prior to advancing the discussion it should be understood that trimming operation by the use of the hair clipper is normally preceded by arranging straggled or disordered hair strands with a comb, and therefore involves three stages, i.e., arrangement of the hair with the comb, holding the hair strands after combing, and advancing the clipper through the hair strands. In view of the above, it is apparently desirable to manipulate the clipper and the comb by the more skillful hand of the two for achieving accurate and easy operation and as well it is desirable to repeat the above three stages continuously during the whole hair styling so as to complete it rapidly and without laborious effort. Besides the above, it is also desirable that the hair strands be held by the human fingers during cutting for the reason that the hair strands thus held are unlikely to slip away through the fingers and is kept in position such that the clipper can accurately follow a desired line of cutting. The hair clipper of the present invention will satisfy all the above requirements by the provision of the finger hooking means 4. That is, in the first stage as illustrated in FIG. 5, the operator, holding the clipper 1 by the fingers inserted in the eyes 35 of the finger hooking means 4 and allowed to hold the comb 37 between the remaining fingers and the thumb, can readily manipulate the comb 37 in order to arrange therewith straggled or disordered hair strands. The second stages follows immediately thereafter as illustrated in FIG. 6 at which the operator moves the comb 37 from the skillful hand to the other hand which concurrently participates to hold the hair strands to be cut between the index and middle fingers, for example. Accordingly, in the third stage as illustrated in FIG. 7, the operator can advance by using with his skillful hand the clipper 1 through the hair strands which are kept in position between the fingers of the opposite hand in order to accurately perform a trimming operation along a desired cutting line. With the result that, one cycle of the above trimming operation can be repeated successively during whole hair styling without releasing the clipper 1 and comb 37 from the hands of the operator, enabling accurate and rapid trimming operation. Further, as illustrated in FIG. 5, the clipper 1 retained by the fingers engaging with the finger hooking means 4 can be also sustained by the palm of the same hand so as to be firmly held in position apart from the comb 37, preventing cutting carelessly of undesired hair in the course of arranging the hair strands with the comb 37. It should be noted at this point that the configuration of the finger hooking means 4 is not limited to the above embodiment and modifications of finger hooking means 4*a* and 4*b* as illustrated in FIGS. 8 and 9 may be available for the same purpose.

Figure 10:
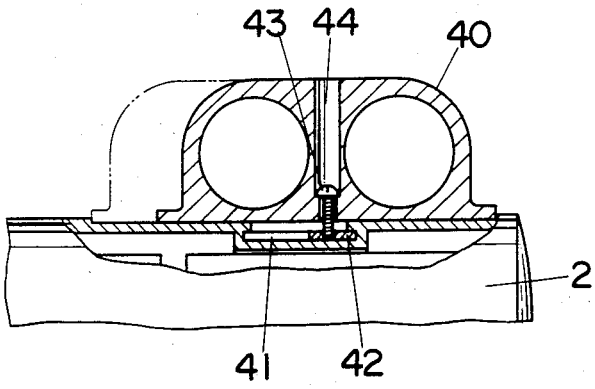
FIG. 10 is a partial diagrammatic view illustrating the connection between finger hooking means and the housing in accordance with another embodiment of the present invention.

Referring to FIG. 10, there is illustrated another embodiment of the present invention characterized in that finger hooking means 40 of same configuration as the above embodiment is capable of sliding along the longitudinal axis of the housing 2 as well as of being detached from the housing 2. The finger hooking means 40 likewise projects in a plane parallel to the cutting plane of the cutter assembly. The housing 2 is provided in its outer periphery with a longitudinally extending groove 41 which confines a slider 42 movable along the entire length thereof. Engaged with the slider 42 is an adjusting screw 43 accessible from a vertically extending well 44 in the finger hooking means 40 to keep the means 40 at any desired position within the length of the groove 41. This is advantageous in that the finger hooking means 40 can be moved to be in an optimum location for easy handling of the clipper, particularly for easy access to the switch located at front portion by the thumb of the hand holding the clipper depending upon the varying sizes of the hands of different users. Additionally, the clipper of course can be used without the finger hooking means 40 when the situation requires.

Figure 11:
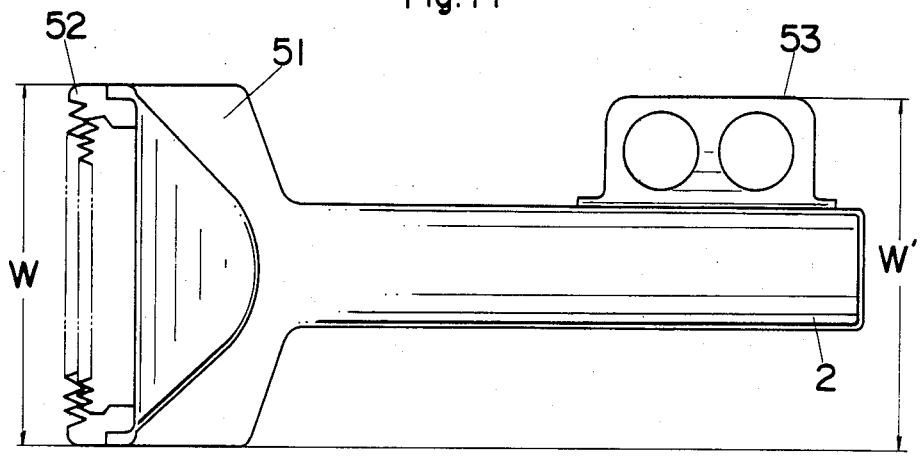
FIG. 11 is a front elevation of a hair clipper in accordance with a further embodiment of the present invention.

FIG. 11 discloses a further embodiment of the present invention in which the housing 2 is in the form of generally T-shaped configurations defined by a transversely extending cutter support 51 at the forward portion and the rest thereof. The cutter support 51 is provided along its entire width of the front end with the cutter assembly 52 and includes within its width W the finger hooking means 53 projecting outwardly and radially from the rear portion of the housing 2 in the same direction as the cutter support 51 extends transversely, i.e., the entire width W of the cutter support 51 is chosen to be greater than the width W′ measured transversly from one or the bottom end of the cutter support 51 to the top end of the finger hooking means 53 as easily understood from the same Figure. With this arrangement, during the trimming operation of the hair at the back, particularly the lower part of the head, the finger hooking means 53 and the fingers engaged therewith will not run against the back of the head or the neck of the subject person such that the trimming operation at that part can be performed without trouble.

Figure 12:
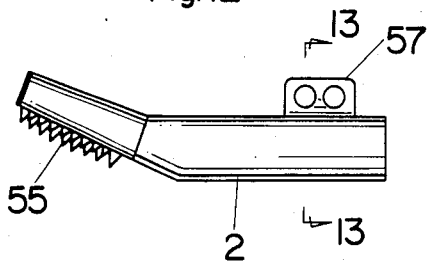
FIG. 12 is a schematic elevation of a hair clipper in accordance with a still further embodiment of the present invention.
Figure 13:
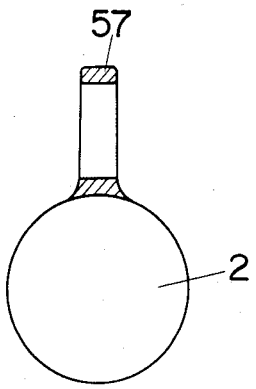
FIG. 13 is a cross section taken along the line 13—13 of FIG. 12.

FIGS. 12 and 13 also illustrate a hair clipper in accordance with a still further embodiment of the present invention wherein the toothed line of cutter assembly 55 is arranged to be inclined with respect to the longitudinal axis of the housing 2 and wherein finger hooking means 57 is of the same construction as in the above embodiment to project in the direction of a plane which lies parallel to and intersects the plane of the toothed line.

Figure 14:
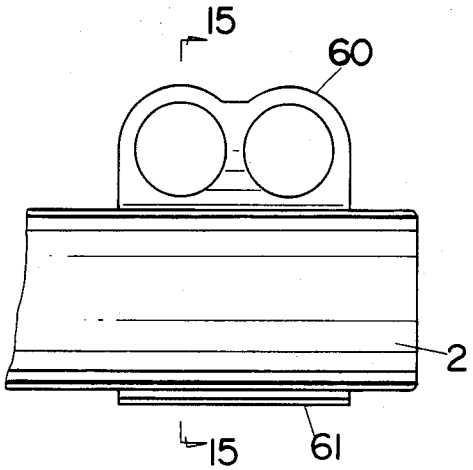
FIG. 14 is a partial view illustrating finger hooking means employed in a further embodiment of the present invention.
Figure 15:
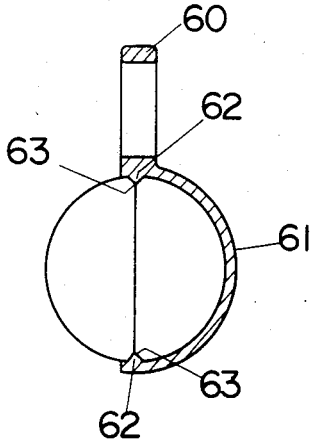
FIG. 15 is a cross section taken along the line 15—15 of FIG. 14.

Referring to FIGS. 14 and 15, there is illustrated a further embodiment of the present invention in which finger hooking means 60 made of a suitable synthetic resin includes an integral frame 61 of semicylinderical shape. The frame 61 is provided at its circumferentially opposite ends with respective projections 62 which snaps in corresponding recesses 63 formed in the outer periphery of the housing 2. The frame 61 is of material which is inherently resilient and allows each projection 62 to slip out the corresponding recess 63 during the rotational movement of the finger hooking means 60 about the axis of the housing 2 and to snap in the recess 63 when the projection is inserted so that the finger hooking means 61 is retained in one of the two angular positions being 180° apart. This enables the hair clipper to be handled both by a right-handed person and a left-handed person merely by changing its angular position from one to the other. It is of course possible to use the hair clipper with the finger hooking means 61 removed.

Figure 16:
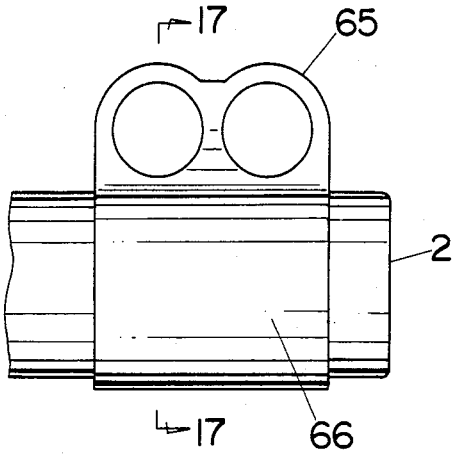
FIG. 16 is a partial view illustrating modification in the finger hooking means construction of the above embodiment.
Figure 17:
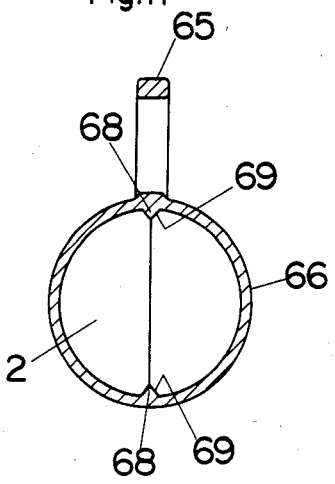
FIG. 17 is a cross section taken along the line 17—17 of FIG. 16.

Illustrated in FIGS. 16 and 17 is a hair clipper of similar construction to the above embodiment except that finger hooking means 65 includes an integral frame 66 of cylinderical shape adapted to enclose the entire circumference of the housing 2. A pair of the same projections 68 are formed on the inner periphery of the frame 66 at the locations 180° apart to snap into corresponding recesses 69 in the outer surface of the housing 2. Besides the advantageous features of the above embodiment, the present embodiment has an additional feature that the finger hooking means 65 can be prevented from being accidentally detached from the housing 2.

Figure 18:
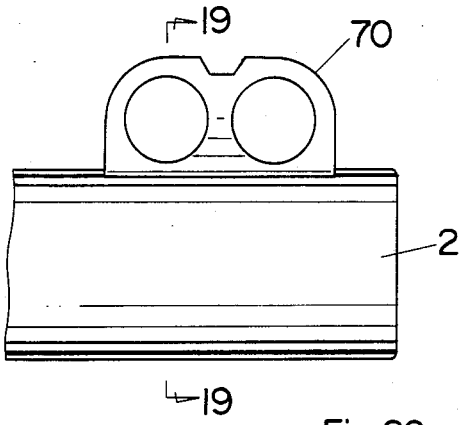
FIG. 18 is a partial view illustrating finger hooking means employed in a still further embodiment of the present invention.
Figure 19:
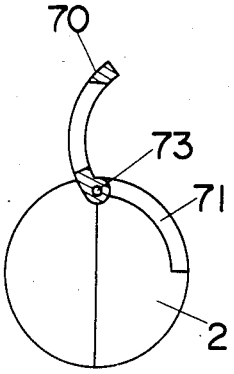
FIG. 19 is a cross section taken along the line 19—19 of FIG. 18.

FIG. 18 and 19 illustrate a still further embodiment of the present invention which is so constructed that finger hooking means 70 can fold into a recess 71 in the housing 2. The finger hooking means 70 is shaped to have an arcuate cross section and is pivotally connected at its lower end to a shaft 73 provided in the outer surface of the housing 2 and extending longitudinally so as to be rotatable about the pivot axis. The recess 71 is in the form of an elongated and arcuate cross section to extend around a portion of the periphery of the housing 2 and receives the whole finger hooking means 70 when it is out of use.

Figure 20:
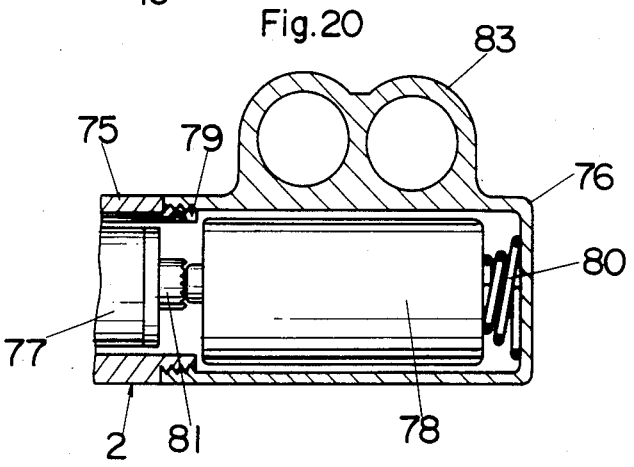
FIG. 20 is a partial view illustrating another embodiment of the present invention.

Referring to FIG. 20, there is illustrated another embodiment of the present invention in which the housing 2 of the hair clipper is divided longitudinally into a front tube 75 and a rear tube 76, the front tube 75 carrying the motor 77 and the cutter assembly, and the rear tube 76 accomodating therein a dry cell 78 energizing the motor 77. The rear tube 76 is an end cap having an internal thread 79 at its open end and a spiral spring 80. When the end cap 76 is screwed onto the threaded end of the front tube, the spring 80 urges the cell 78 along the housing 2 such that the positive terminal thereof makes positive electrical contact with an electrical contact member 81 of the motor 77 while the negative terminal of the cell 78 makes contact via the spring 80 and a manual switch with a corresponding member of the motor 77. Projected from the surrounding wall of the end cap is finger hooking means 83 which is of similar construction to the above embodiments and serves, in addition to the above basic functions, as an aid for facilitating the operation of engaging with and disengaging from the front tube 75.

The above embodiments and particularly the drawings are set forth for purposes of illustration only. It will be understood that many variations and modifications of the embodiment herein described will be obvious to those skilled in the art, and may be carried out without departing from the spirit and scope of the invention.

What is claimed is:

1. A hair clipper for use in cutting human hair comprising a tubular housing having a longitudinal axis and adapted to be grasped by the hand of an operator, a power driven cutter assembly mounted transversely across the forward end of the housing and including a movable cutter which is driven by drive means accomodated in the housing to reciprocate for cutting hair, and finger hooking means projecting outwardly from the surrounding wall of the housing, the finger hooking means having at least one eye for receiving therein any one of the middle, ring, and little fingers of the hand grasping the housing so as to suspend the housing by the finger received in said eye and means mounting the finger hooking means for movement along said longitudinal axis toward and away from said cutter assembly, the means for mounting the finger hooking means comprising a longitudinally extending groove in the housing and a slider confined behind the groove for longitudinal movement along said groove, a screw passing through said finger hooking means and threaded into said slider so that the screw may be loosened, the finger hooking means and slider moved to a new longitudinal position and the screw tightened to hold the finger hooking means in the new position.

2. The hair clipper as set forth in claim 1, including a switch handle for turning on and off the driving operation of the cutter assembly, said switch handle being mounted on the housing at a location diametrically opposite to said finger hooking means.

3. The hair clipper as set forth in claim 1, wherein said finger hooking means lies in a plane parallel to the cutting plane in which said movable cutter is driven to reciprocate.

4. The hair clipper as set forth in claim 1, wherein said housing has at its forward portion an integral cutter support which extends transversely of the housing to have a greater width than the rest of the housing so as to shape the whole housing in the form of generally T-shaped configuration, and wherein said cutter assembly is mounted at the forward end of the cutter support to extend along substantially the entire width thereof and parallel with the plane of said finger hooking means projecting from the rear portion of the housing such that the finger hooking means is disposed within the width of the cutter support.

5. The hair clipper as set forth in claim 1, wherein said finger hooking means is detachably mounted on the housing.

6. The hair clipper as set forth in claim 1, wherein said finger hooking means is provided with a pair of longitudinally aligned eyes for receiving any combination of two adjacent ones of the middle, ring, and little fingers.

* * * * *